US011094436B2

(12) United States Patent
Yoon et al.

(10) Patent No.: US 11,094,436 B2
(45) Date of Patent: Aug. 17, 2021

(54) RESISTOR COMPONENT

(71) Applicant: SAMSUNG ELECTRO-MECHANICS CO., LTD., Suwon-si (KR)

(72) Inventors: Ji Sook Yoon, Suwon-si (KR); Kwang Hyun Park, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 0 days.

(21) Appl. No.: 16/889,982

(22) Filed: Jun. 2, 2020

(65) Prior Publication Data

US 2021/0202137 A1 Jul. 1, 2021

(30) Foreign Application Priority Data

Dec. 27, 2019 (KR) ..... 10-2019-0176428

(51) Int. Cl.
*H01C 1/14* (2006.01)
*H01C 17/065* (2006.01)
*H01C 7/00* (2006.01)

(52) U.S. Cl.
CPC ..... *H01C 1/14* (2013.01); *H01C 7/003* (2013.01); *H01C 17/065* (2013.01)

(58) Field of Classification Search
CPC ..... H01C 1/14; H01C 7/003; H01C 17/24; H01C 17/242; H01C 17/065
See application file for complete search history.

(56) References Cited

U.S. PATENT DOCUMENTS 6,171,921 B1 * 1/2001 Dunn ..... H01C 17/003 427/101
6,272,736 B1 * 8/2001 Lee ..... H01C 1/032 257/E21.006
6,703,683 B2 * 3/2004 Tanimura ..... H01C 7/006 257/536
6,943,662 B2 * 9/2005 Tanimura ..... H01C 1/142 257/537
8,354,912 B2 * 1/2013 Yoneda ..... H01C 7/003 338/306
10,347,404 B2 * 7/2019 Park ..... H01C 17/06526
2002/0031860 A1 3/2002 Tanimura
2003/0154592 A1 * 8/2003 Felten ..... H01C 7/003 29/610.1
2018/0075954 A1 * 3/2018 Matsumoto ..... H01C 1/142
2018/0090247 A1 * 3/2018 Matsumoto ..... H01C 7/003

FOREIGN PATENT DOCUMENTS

JP 2002-064002 A 2/2002

* cited by examiner

*Primary Examiner* — Kyung S Lee
(74) *Attorney, Agent, or Firm* — Morgan, Lewis & Bockius LLP

(57) ABSTRACT

A resistor component includes an insulating substrate; a resistance layer disposed on one surface of the insulating substrate; and first and second terminals disposed on the insulating substrate to be spaced apart from each other and connected to the resistance layer, wherein each the first and second terminals comprises an inner electrode layer disposed on the resistance layer, and a via electrode penetrating the resistance layer to be in contact with the one surface of the insulating substrate and the inner electrode layer.

17 Claims, 3 Drawing Sheets

RESISTOR COMPONENT

CROSS-REFERENCE TO RELATED APPLICATION(S)

The present application claims the benefit of priority to Korean Patent Application No. 10-2019-0176428 filed on Dec. 27, 2019 in the Korean Intellectual Property Office, the disclosure of which is incorporated herein by reference in its entirety.

TECHNICAL FIELD

The present disclosure relates to a resistor component.

BACKGROUND

A resistor component is a passive electronic component used to implement a precise degree of resistance and serves to adjust a current and drop a voltage in an electronic circuit.

In the case of a general resistor component, a resistor paste is applied to an insulating substrate and is sintered to forma resistor layer, and a resistance value is adjusted via a laser trimming process.

Meanwhile, due to a thermal impact during the laser trimming process, a stress is applied to the resistance layer, and this may result in deteriorated resistance characteristics of the resistance layer.

SUMMARY

An aspect of the present disclosure may provide a resistor component capable of easily reducing resistance distribution.

According to an aspect of the present disclosure, a resistor component includes an insulating substrate; a resistance layer disposed on one surface of the insulating substrate; and first and second terminals disposed on the insulating substrate to be spaced apart from each other and connected to the resistance layer, wherein each the first and second terminals comprises an inner electrode layer disposed on the resistance layer, and a via electrode penetrating the resistance layer to be in contact with the one surface of the insulating substrate and the inner electrode layer.

According to an aspect of the present disclosure, a resistor component includes an insulating substrate; first and second terminals disposed on opposing end surfaces of the insulating substrate to be spaced apart from each other; and a resistance layer disposed on one surface of the insulating substrate connecting the opposing end surfaces to each other, wherein each of the first and second terminals comprises: an outer electrode layer disposed on a respective one of the opposing end surfaces of the insulting substrate and extending on the one surface of the insulting substrate; an inner electrode layer sandwiched between an extended portion of the outer electrode layer and the resistance layer; and a via electrode extending from the inner electrode to be in contact with the one surface of the insulating substrate.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
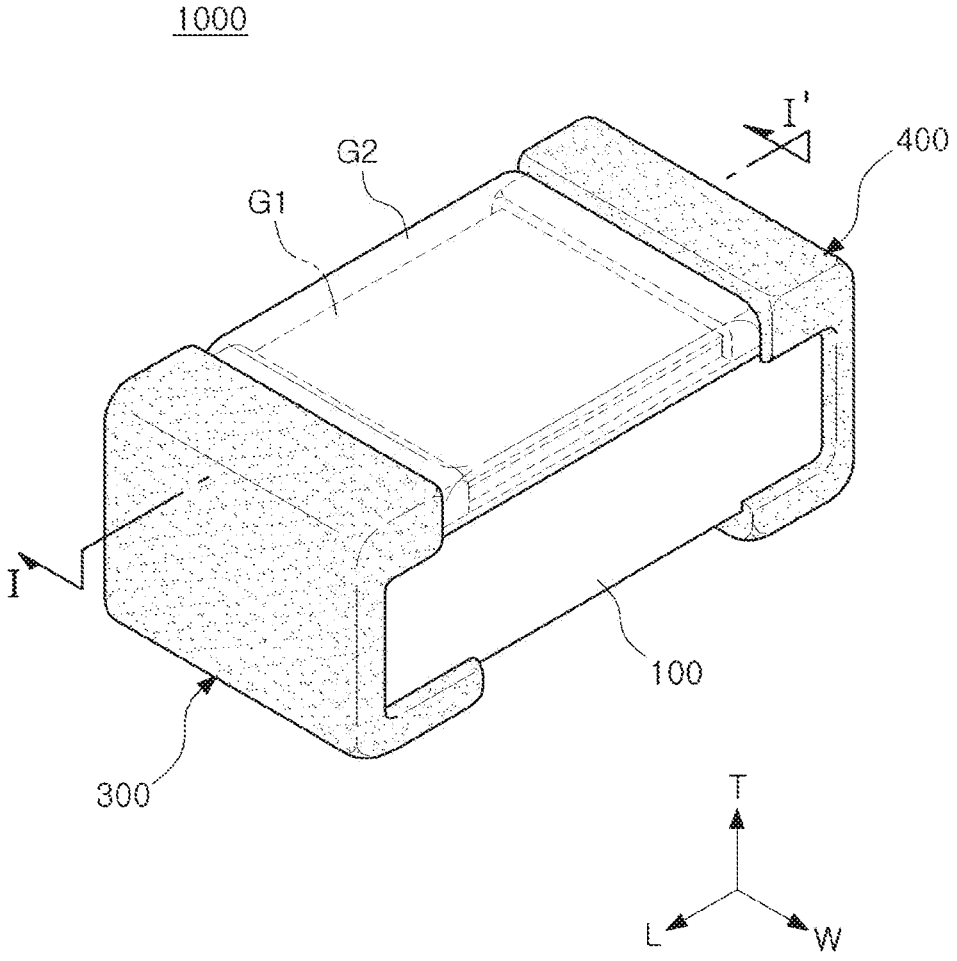
FIG. 1 is a schematic diagram illustrating a resistor component according to Exemplary Embodiment 1 of the present disclosure.

Hereinbelow, terms referring to the elements of the present disclosure are named in consideration of the functions of the respective elements, and thus should not be understood as limiting the technical elements of the present disclosure. As used herein, singular forms may include plural forms as well unless the context explicitly indicates otherwise. Further, as used herein, the terms "include", "have", and their conjugates denote a certain feature, numeral, step, operation, element, component, or a combination thereof, and should not be construed to exclude the existence of or a possibility of addition of one or more other features, numerals, steps, operations, elements, components, or combinations thereof. In addition, it will be the term "on" does not necessarily mean that any element is positioned on an upper side based on a gravity direction, but means that any element is positioned above or below a target portion.

Throughout the specification, it will be understood that when an element or layer is referred to as being "connected to" or "coupled to" another element or layer, it can be understood as being "directly connected" or "directly coupled" to the other element or layer or intervening elements or layers may be present. It will be further understood that the terms "comprises," "comprising," "includes," and/or "including" specify the presence of elements, but do not preclude the presence or addition of one or more other elements.

The size and thickness of each component illustrated in the drawings are represented for convenience of explanation, and the present disclosure is not necessarily limited thereto.

In the drawings, the expression "W direction" may refer to "first direction" or "width direction," and the expression "L direction" may refer to "second direction" or "length direction" while the expression "T direction" may refer to "third direction" or "thickness direction".

Hereinafter, exemplary embodiments of the present disclosure will now be described in detail with reference to the accompanying drawings. The same or corresponding components were given the same reference signs and will not explained further.

Figure 2:
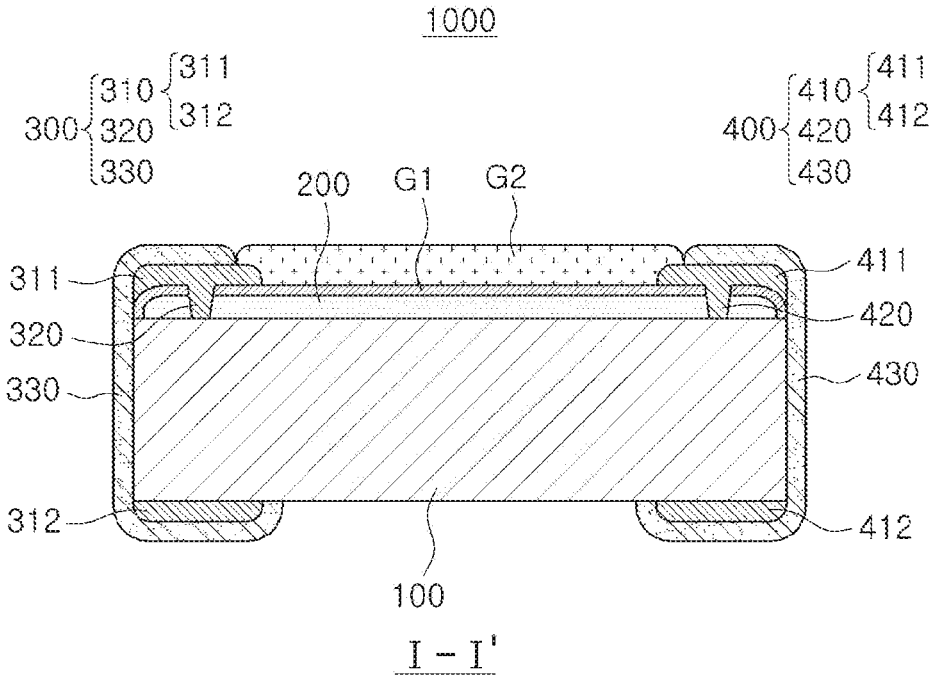
FIG. 2 is a cross-sectional view taken along line I-I' of FIG. 1.

FIG. 1 is a schematic diagram illustrating a resistor component according to Exemplary Embodiment 1 of the present disclosure, and FIG. 2 is a cross-sectional view taken along line I-I' of FIG. 1.

Based on FIGS. 1 and 2, a resistor component 1000 according to Exemplary Embodiment 1 of the present disclosure includes an insulating layer 100, a resistance layer 200, a protective layer G1 and terminals 300 and 400 and may further include a cover layer G2. The terminals 300 and 400 include inner electrode layers 310 and 410 and via electrodes 320 and 420.

The insulating substrate 100 may be provided in a plate shape having a predetermined thickness and may contain a material effectively dissipating heat generated in the resistance layer 200. The insulating substrate 100 may contain a ceramic insulating material such as an alumina ($Al_2O_3$), but is not limited thereto. The insulating substrate 100 may contain a polymer material. As an example, the insulating substrate 100 may be an alumina insulating substrate obtained by anodizing an aluminum surface, but is not limited thereto. The insulating substrate 100 may be a sintered alumina substrate.

The resistance layer 200 is disposed on one surface of the insulating substrate 100.

The resistance layer 200 may contain a metal, a metal alloy or a metal oxide. For example, the resistance layer 200 may contain at least one of a copper (Cu)-nickel (Ni) alloy, a Ni-(chromium) Cr alloy, a ruthenium (Ru) oxide, a silicon (Si) oxide and a manganese (Mn)-based alloy. For example, the resistance layer 200 may be formed of a lead (Pb)-free paste containing a Pb-free alloy or a Pb-free alloy oxide.

The resistance layer 200 may be formed by a thick film process. For example, the resistance layer 200 may be formed by applying a paste for resistance layer formation, in which a metal, a metal alloy, a metal oxide, or the like, is contained on one surface of the insulating substrate 100, by a screen printing method and sintering the same.

The protective layer G1 is disposed between the resistance layer 200 and the inner electrode layers 310 and 410 of the terminals 300 and 400 to protect the resistance layer 200. The protective layer G1 can prevent the resistance layer 200 from being broken or depleted when a via hole is formed on the resistance layer 200 to form via electrodes 320 and 420. The protective layer G1 may be formed to be larger than the resistance layer 200 so as to protect the resistance layer 200.

The protective layer G1 may be disposed on the one surface of the insulating substrate 100 by applying a paste for protective layer formation to the one surface of the insulating substrate 100 on which the protective layer G1 is formed and sintering the same. The protective layer G1 may be formed using a paste containing a glass such that improved binding to the insulating substrate 100 can prevent separation of the resistance layer 200.

The first and second terminals 300 and 400 are spaced apart on the insulating substrate 100 and are connected to the resistance layer 200. Specifically, the first and second terminals 300 and 400 are disposed on both cross-sections of the insulating substrate 100 and are thus spaced apart so as to face each other in a length direction L.

The terminals 300 and 400 includes the inner electrode layers 310 and 410, the via electrodes 320 and 420 and outer electrode layers 330 and 430. Specifically, based on a direction of FIG. 2, the first terminal 300 includes a first inner electrode layer 310 having a first upper electrode 311 disposed on the resistance layer 200 and a first lower electrode 312 disposed on a lower surface of the insulating substrate 100; a first via electrode 320 penetrating the resistance layer 200 and the protective layer G1 to be in contact with the first upper electrode 311 and the upper surface of the insulating layer 100; and the first outer electrode layer 330. The second terminal 400 includes a second inner electrode layer 410 having a second upper electrode 411 disposed on the resistance layer 200 and a second lower electrode 412 disposed on a lower surface of the insulating substrate 100; a second via electrode 420 penetrating the resistance layer 200 and the protective layer G1 to be in contact with the second upper electrode 411 and the upper surface of the insulating layer 100; and the second outer electrode layer 420.

The inner electrode layers 310 and 410 may be formed by applying a conductive paste on one surface and the other surface of the insulating layer 100 followed by sintering. The conductive paste for forming the inner electrode layers 310 and 410 may be a metal powder, where the metal may be copper (Cu), silver (Ag), nickel (Ni), or the like, a binder and a glass. Accordingly, the inner electrode layers 310 and 410 may contain a glass and a metal. Meanwhile, the process of forming the upper electrodes 311 and 411 is carried out after forming the via hole for the via electrode formation on the resistance layer 200 and the protective layer G1. In the meantime, the process of forming the lower electrodes 312 and 412 can be either before or after the via hole is formed.

The via electrodes 320 and 420 may be formed by sequentially forming the resistance layer 200 and the protective layer G1 on the insulating substrate 100, forming a via hole penetrating the same using a laser process and filling the via hole with the conductive paste for via hole formation followed by sintering the same. When the via electrodes 320 and 420 are formed by sintering, the via electrodes 320 and 420 may not contain a resin, in contrast to the case in which a curable conductive paste is used. The via electrodes 320 and 420 of the present exemplary embodiment is sintered electrodes.

The via electrodes 320 and 420 and the upper electrodes 311 and 411 may be formed in the same process, thus being integrally formed. That is, no interface may be formed between the via electrodes 320 and 420 and the upper electrodes 311 and 411, but the present disclosure is not limited thereto.

The via electrodes 320 and 420 has one surface in contact with the insulating substrate 100 whose surface area may be smaller than that of the other surface in contact with the upper electrodes 311 and 411. In this case, damage on the insulating substrate 100 can be reduced during the process of via hole formation involving exposing the insulating substrate 100, and connectivity between the via electrodes 320 and 420 and the upper electrodes 311 and 411 can be improved by increasing a contact surface area.

Conventionally, when a resistor component has inner electrode layers and a resistance layer formed by a thick film process, a resistance distribution value is high, which requires a laser trimming process to reduce the resistance distribution. As a linear process is carried out during the laser trimming process, the laser trimming process is carried out in a relatively large surface area on the resistance layer and involves heat generated by the laser. Accordingly, the resistance layer may be broken or depleted, thereby increasing a defect percentage.

In the case of the present disclosure, the above problems can be alleviated by forming the resistance layer 200 and forming the via hole in a relatively simple and highly precise manner along with filling the via hole (via hole-forming process). That is, a resistance distribution value can be reduced by forming the via hole on the resistance layer 200 and forming the via electrodes 320 and 420 in the via hole using a laser process having relatively high precision and a relatively small process surface area. Due to the relatively high precision of the laser, a distance distribution between the first and second via electrodes 320 and 420, and as a result, a resistance distribution can be reduced. This may also result in a reduced contact surface area distribution between the via electrodes 320 and 420 and the resistance layer 200.

In the present exemplary embodiment, a protective layer G1 is disposed between the inner electrode layers 310 and 410 and the resistance layer 200 in the form in which the protective layer G1 covers the entire resistance layer 200. As such, inner electrode layers 310 and 410 are not in contact with the resistance layer 200 and are electrically connected thereto only through the via electrodes 320 and 420. That is, in the case of the present exemplary embodiment, the only configuration in the terminals 300 and 400, which is in contact with the resistance layer 200, is the via electrodes 320 and 420. The inner electrode layers 310 and 410 and the resistance layer 200 are formed by a thick film process, and thus has at least one distribution of the thickness, length and surface profile. In this regard, the resistance distribution increases when the inner electrode layers 310 and 410 and the resistance layer 200 are in contact with each other. In the case of the present exemplary embodiment, instead of allowing the inner electrode layers 310 and 410 and the resistance layer 200, which are factors that increases the resistance distribution, to be in contact, the inner electrode layers 310 and 410 and the resistance layer 200 are electrically connected to each other through the via electrodes 320 and 420, which have comparatively uniform diameter and surface area. This may serve to reduce the resistance distribution.

The outer electrode layers 330 and 430 may be formed by, for example, a vapor deposition method such as sputtering, a plating method, paste printing, or the like. When the outer electrode layers 330 and 430 are formed by the plating method, a seed layer for forming the outer electrode layers 330 and 430 may be disposed on one surface and the other surface of the insulating substrate 100, although not illustrated in the drawing. The seed layer may be formed by a vapor deposition method such as an electroless plating method, sputtering, or the like, or a printing method. The outer electrode layers 330 and 430 may contain at least one of titanium (Ti), chromium (Cr), molybdenum (Mo), copper (Cu), silver (Ag), nickel (Ni), tin (Sn) and alloys thereof.

The outer electrode layers 330 and 430 may be formed in multilayers. As an example, the first outer electrode layer 330 may include a first layer disposed on one side surface of the insulating substrate 100, and a second layer extending onto the one surface and the other surface of the insulating substrate 100 to cover the upper electrodes 311 and 411 and the lower electrodes 312 and 412, respectively. The first layer may be formed by printing a paste containing a metal powder, where the metal is Cu, Ag, Ni, or the like, followed by curing or sintering. The first layer may be formed by an electroless plating method or a vapor deposition method such as sputtering. The second layer may be formed by a plating method. The second layer may have a multilayer structure, such as a Ni depositing layer/Ni depositing layer, but is not limited thereto.

The cover layer G2 is disposed on the protective layer G1 and extend onto at least a portion of the inner electrode layers 310 and 410. The cover layer G2, together with the protective layer G1, is a configuration for protecting the resistance layer 200 from an external impact, and may be formed on the insulating substrate 100 after the inner electrode layers 310 and 410 are formed. The cover layer G2 may be formed by applying a curing paste containing a thermoplastic resin and/or a photocurable resin to the upper electrodes 311 and 411 and the protective layer G1, followed by curing.

In one exemplary embodiment, the cover layer G2 directly disposed on the protective layer G1.

Figure 3:
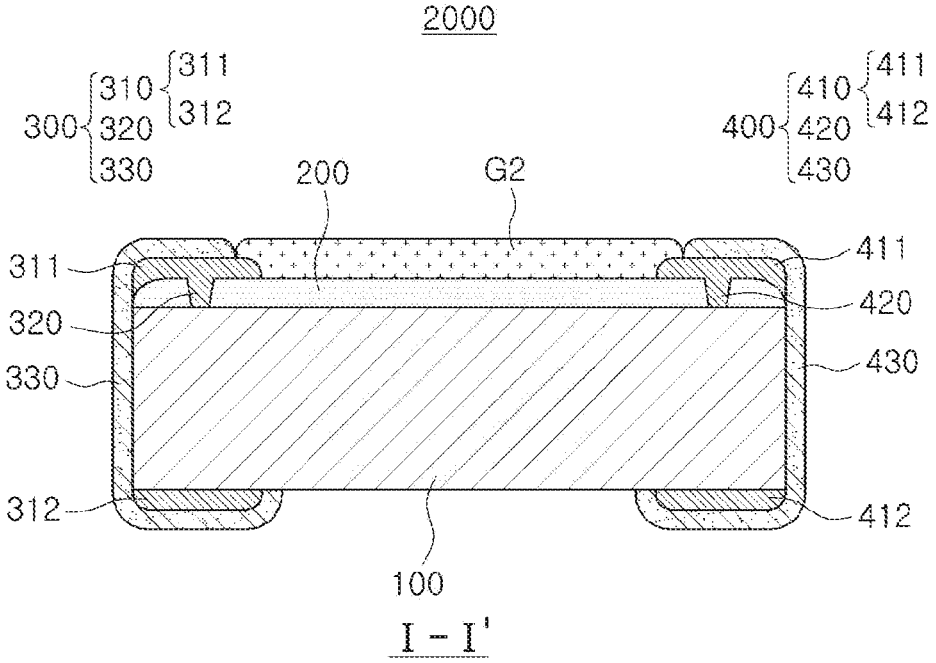
FIG. 3 is a schematic diagram illustrating a resistor component according to Exemplary Embodiment 2 and corresponding to the cross-section taken along line I-I' of FIG. 1.
Figure 4:
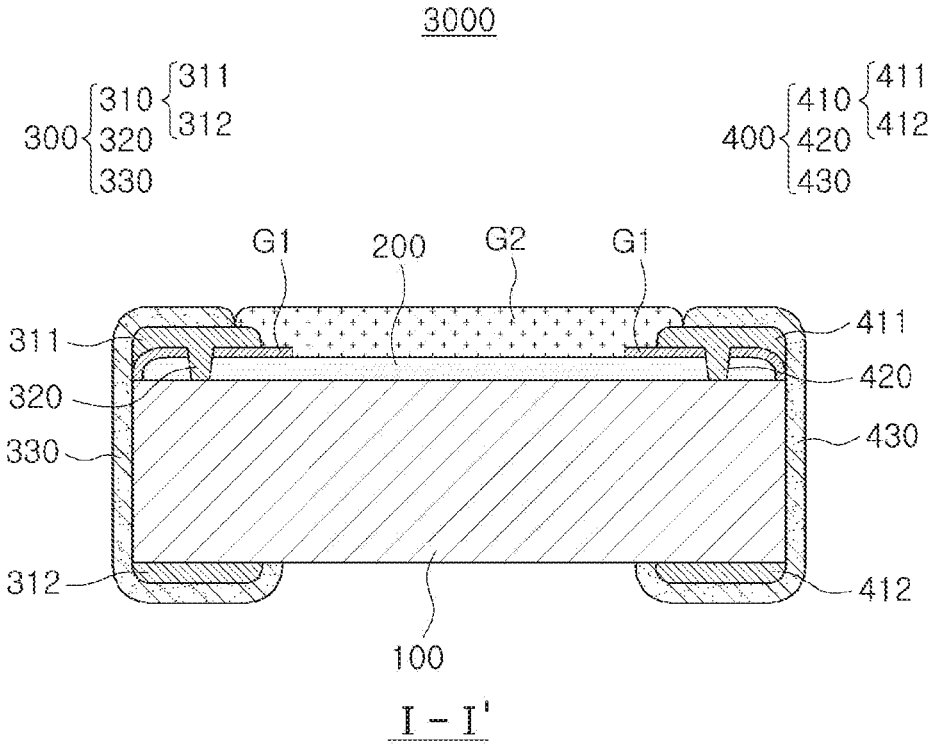
FIG. 4 is a schematic diagram illustrating a resistor component according to Exemplary Embodiment 3 and corresponding to the cross-section taken along line I-I' of FIG. 1.

FIG. 3 is a schematic diagram illustrating a resistor component according to Exemplary Embodiment 2 and corresponding to the cross-section taken along line I-I' of FIG. 1. FIG. 4 is a schematic diagram illustrating a resistor component according to Exemplary Embodiment 3 and corresponding to the cross-section taken along line I-I' of FIG. 1.

In comparison of FIGS. 1 to 4, the resistor components 2000 and 3000 according to Exemplary Embodiments 2 and 3 are different from the resistor component 1000 according to Exemplary Embodiment 1 in terms of the protective layer G1 and the cover layer G2. Accordingly, the protective layer G1 and the cover layer G2, different from those of Exemplary Embodiment 1, will only be described in describing Exemplary Embodiments 2 and 3.

Based on FIG. 3, the protective layer (G1 of FIG. 2) may be omitted from the resistor component 2000 according to Exemplary Embodiment 2, such that the cover layer G2 is directly disposed on the resistance layer 200. The protective layer (G1 of FIG. 2) is a configuration for preventing the resistance layer from being broken and depleted during the via hole formation; however, the via hole of the present disclosure is formed in a relatively smaller surface area (or volume) on the resistance layer 200, and accordingly, the protective layer G1 is omitted in the present exemplary embodiment. This may serve to reduce manufacturing costs and a number of processes.

Meanwhile, in the case of the present exemplary embodiment, the protective layer (G1 of FIG. 2) is not formed on the resistance layer 200, and as a result, the upper electrodes 311 and 411 and the cover layer G2 may be in contact with the resistance layer 200.

Based on FIG. 4, the protective layer G1 in the resistor component 3000 according to Exemplary Embodiment 3 may be configured to cover an overlapping area of the resistance layer 200 with the upper electrodes 311 and 411 and may be spaced apart from another protective layer on the resistance layer 200. Specifically, based on FIG. 4, the first protective layer G1 is disposed between the first upper electrode 311 and the resistance layer 200 so as to cover the overlapping area therebetween. A second protective layer G1 is disposed between the second upper electrode 411 and the resistance layer 200 so as to cover the overlapping area therebetween. The first protective layer G1 and the second protective layer G1 are disposed on the resistance layer 200 to be spaced apart from each other. Meanwhile, due to the configuration of the protective layer G1 previously described, the cover layer G2 applied to the present exemplary embodiment may be formed to be in contact with the upper electrodes 311 and 411, the protective layer G1 and the resistance layer 200. As such, the cover layer G2 may be directly disposed on a portion of the protective layer G1 and a portion of the resistance layer 200.

In the case of the present exemplary embodiment, the protective layer G1 is formed while minimizing a formation surface area thereof, thereby reducing the resistance distribution as well as manufacturing costs. That is, in the present exemplary embodiment, the inner electrode layers 310 and 410 are indirectly connected to the resistance layer 200 by the via electrodes 320 and 420 as in Exemplary Embodiment 1, resulting in a reduced resistance distribution. In addition, the protective layer G1 is formed to cover the overlapping area between the upper electrodes 311 and 411 and the resistance layer 200, thereby minimizing a formation surface area.

As set forth above, according to the present disclosure, a resistance distribution of a resistor component can be more easily reduced.

While exemplary embodiments have been shown and described above, it will be apparent to those skilled in the art that modifications and variations could be made without departing from the scope of the present invention as defined by the appended claims.

What is claimed is:

1. A resistor component, comprising:

an insulating substrate;

a resistance layer disposed on one surface of the insulating substrate; and first and second terminals disposed on the insulating substrate to be spaced apart from each other and connected to the resistance layer, wherein each of the first and second terminals comprises an inner electrode layer disposed on the resistance layer, and a via electrode penetrating the resistance layer to be in contact with the one surface of the insulating substrate and the inner electrode layer, wherein the resistor component further comprises a second layer disposed between the resistance layer and the inner electrode layer, and wherein the via electrode penetrates the resistance layer and the second layer.

2. The resistor component of claim 1, wherein a cross-sectional area of one surface of the via electrode in contact with the one surface of the insulating surface is smaller than a cross-sectional area of another surface of the via electrode in contact with the inner electrode layer.

3. The resistor component of claim 1, wherein the via electrode and the inner electrode layer are integrally formed.

4. The resistor component of claim 1, wherein the via electrode is free of a resin.

5. The resistor component of claim 1, further comprising a cover layer disposed on the second layer and extending onto at least a portion of the inner electrode layer.

6. The resistor component of claim 5, wherein the cover layer is directly disposed on the second layer.

7. The resistor component of claim 5, wherein the cover layer comprises a curable resin.

8. The resistor component of claim 1, wherein the second layer includes a first portion and a second portion spaced apart from each other, the first portion disposed between the inner electrode layer of the first terminal and the resistance layer, and the second portion disposed between the inner electrode layer of the second terminal and the resistance layer.

9. The resistor component of claim 8, wherein the first and second terminals are connected to the resistance layer only through the via electrode.

10. The resistor component of claim 1, further comprising a cover layer disposed on the second layer and the resistance layer and extending onto at least a portion of the inner electrode layer.

11. The resistor component of claim 10, wherein the cover layer is directly disposed on a portion of the second layer and a portion of the resistance layer.

12. The resistor component of claim 1, wherein the first and second terminals are connected to the resistance layer only through the via electrode.

13. A resistor component, comprising:

an insulating substrate;

first and second terminals disposed on opposing end surfaces of the insulating substrate to be spaced apart from each other; and a resistance layer disposed on one surface of the insulating substrate connecting the opposing end surfaces to each other, wherein each of the first and second terminals comprises:

an outer electrode layer disposed on a respective one of the opposing end surfaces of the insulting substrate and extending on the one surface of the insulting substrate;

an inner electrode layer sandwiched between an extended portion of the outer electrode layer and the resistance layer; and a via electrode extending from the inner electrode to be in contact with the one surface of the insulating substrate, wherein the resistor component further comprises a second layer disposed between the resistance layer and the inner electrode layer, and wherein the via electrode penetrates the resistance layer and the second layer.

14. The resistor component of claim 13, wherein the via electrode penetrates the resistance layer.

15. The resistor component of claim 13, wherein a cross-sectional area of one end the via electrode close to the inner electrode layer is greater than a cross-sectional area of another end the via electrode close to the insulating substrate.

16. The resistor component of claim 13, further comprising a cover layer disposed on the second layer and extending onto at least a portion of the inner electrode layer.

17. A resistor component, comprising:

an insulating substrate;

first and second terminals disposed on opposing end surfaces of the insulating substrate to be spaced apart from each other; and a resistance layer disposed on one surface of the insulating substrate connecting the opposing end surfaces to each other, wherein each of the first and second terminals comprises:

an outer electrode layer disposed on a respective one of the opposing end surfaces of the insulting substrate and extending on the one surface of the insulting substrate;

an inner electrode layer sandwiched between an extended portion of the outer electrode layer and the resistance layer; and a via electrode extending from the inner electrode to be in contact with the one surface of the insulating substrate, wherein the resistor component further comprises a second layer disposed between the resistance layer and the inner electrode layer, and wherein the resistor component further comprises a cover layer disposed on the second layer and extending onto at least a portion of the inner electrode layer.

* * * * *